US005092940A

United States Patent [19]

Kimura et al.

[11] Patent Number: 5,092,940

[45] Date of Patent: Mar. 3, 1992

[54] PROCESS FOR PRODUCTION OF TITANIUM AND TITANIUM ALLOY MATERIAL HAVING FINE EQUIAXIAL MICROSTRUCTURE

[75] Inventors: Kinichi Kimura; Masayuki Hayashi; Mitsuo Ishii; Hirofumi Yoshimura, all of Hikari; Jin-ichi Takamura, Kawasaki, all of Japan

[73] Assignee: Nippon Steel Corporation, Tokyo, Japan

[21] Appl. No.: 494,754

[22] Filed: Mar. 16, 1990

[30] Foreign Application Priority Data

Mar. 20, 1989 [JP] Japan ..... 1-65982
Oct. 16, 1989 [JP] Japan ..... 1-266311

[51] Int. Cl.[5] ..... C22F 1/18
[52] U.S. Cl. ..... 148/11.5 F; 148/133
[58] Field of Search ..... 148/11.5 F, 133, 421; 423/644

[56] References Cited

U.S. PATENT DOCUMENTS 2,892,742 6/1959 Zwicker et al. ..... 148/133
4,415,375 11/1983 Lederich et al. ..... 148/11.5 F
4,680,063 7/1987 Vogt et al. ..... 148/11.5 F

FOREIGN PATENT DOCUMENTS 63-4908B 2/1988 Japan .
63-4914B 2/1988 Japan .

OTHER PUBLICATIONS

W. R. Kerr et al. "Hydrogen as an alloying element in titanium" pp. 2477–2486, Titanium '80.
N. C. Birla et al. "Anisotropy control through the use of hydrogen in Ti-6Al-4V alloy" Transactions of the Indian Institute of Metals, vol. 37, No. 5, Oct. 1984, pp. 631–635.
European Search Report, EP 90105106.

*Primary Examiner*—W. Dean
*Assistant Examiner*—Robert R. Koehler
*Attorney, Agent, or Firm*—Kenyon & Kenyon

[57] ABSTRACT

In the production of titanium and $(\alpha+\beta)$-type titanium alloy materials, a material hydrogenated in an amount of 0.02 to 2% by weight of hydrogen is worked at a temperature of 450° to 900° C. at a reduction of more than 60%, and the material is dehydrogenated and annealed in vacuum. The working of the titanium material is carried out at 450° to 800° C., and the working of the $(\alpha+\beta)$-type titanium alloy material is carried out at 550° to 900° C. Furthermore, in the production of titanium, $\alpha$-type titanium alloy, and $(\alpha+\beta)$-type titanium alloy materials, a material hydrogenated in an amount of 0.02 to 2% by weight of hydrogen is subjected to a heat treatment wherein the material is heated at a temperature not lower than the $\beta$ transformation temperature and then cooled, the material is worked at a temperature of 450° to 950° C. at a reduction not lower than 20%, the material is dehydrogenated and annealed in the vacuum, the working of the titanium material is carried out at 450° to 800° C., the working of the $\alpha$-type titanium alloy material is carried out at 600° to 950° C., and the working of the $(\alpha+\beta)$-type titanium alloy material is carried out at 550° to 900° C.

7 Claims, 2 Drawing Sheets

(x 500)

(x 500)

(x500)

PROCESS FOR PRODUCTION OF TITANIUM AND TITANIUM ALLOY MATERIAL HAVING FINE EQUIAXIAL MICROSTRUCTURE

BACKGROUND OF THE INVENTION (1) Field of the Invention

The present invention relates to a process for the production of a titanium (commercially pure titanium) or titanium alloy material having an excellent fatigue strength and workability. More particularly, the present invention relates to a process for the production of a titanium or titanium alloy material having a fine equiaxial microstructure.

(2) Description of the Related Art

Since titanium and titanium alloy materials have a high specific strength (high strength-to-density ratio) and an excellent corrosion resistance, they are used for the production of airplane parts and in many other materials, and the uses of these materials have been expanded. The reason why a titanium material, an $\alpha$-type titanium alloy material, and an $(\alpha+\beta)$-type titanium alloy material are in such demand is that they have an excellent strength and ductility. The requirements for the properties are very severe in respective fields, and especially in the field of airplane parts to be used in the environment where a repeated stress is applied, not only an excellent workability but also an strong fatigue characteristic is required, and severe quality standards (such as seen in AMS 4967) have been stipulated. To satisfy these requirements, the microstructure of the material must have a sufficiently fine $\alpha$-phase equiaxial grains.

In a commercially pure titanium material, however, since the impurity components are limited, it is impossible to realize a uniform and fine microstructure by conventional processing and heat treatments, although an equiaxial microstructure can be produced.

For the $\alpha$-type titanium alloy material and $(\alpha+\beta)$-type titanium alloy material, shaped materials such as sheets, wires, tubes and rods to be used in the above-mentioned fields are generally prepared by the combination of a hot rolling and a heat treatment, but the conventional technique is defective in that, at the hot rolling step, the range of temperatures suitable for (1) maintaining a workability good enough to obtain a material shape having a high precision and (2) producing an equiaxial microstructure in the material, is very narrow.

Furthermore, in this temperature range, the microstructure of the material is easily changed by a change of the temperature, even by a slight rise of the temperature, and crystal grains grow and the microstructure after the treatment is often uneven. Moreover, a problem arises in that the microstructure formed by the hot working is little changed by a subsequent heat treatment.

Under this background, the following processes for obtaining $\alpha$-type and $(\alpha+\beta)$-type titanium alloy materials having an equiaxial microstructure have been proposed.

(1) Japanese Examined Patent Publication No. 63-4914 discloses a process in which heating and working are repeated in a specific narrow temperature range. This process, however, is defective in that the microstructure cannot be made sufficiently fine and uniform and the attained equiaxiality is still unsatisfactory, and the productivity is low and the manufacturing cost high.

(2) Japanese Examined Patent Publication No. 63-4908 discloses a process in which a hot-rolled material is heated in a specific temperature range of the single $\beta$-phase and is heat-treated. This process is defective, however, in that a microstructure which is sufficiently uniform and fine cannot be obtained and the attained equiaxiality is unsatisfactory.

A technique of improving the workability or microstructure of titanium alloy by adding hydrogen as a temporary alloy element (hydrogenation) is known, and the following processes utilizing this technique are known.

(3) U.S. Pat. No. 2,892,742 (June 30, 1958) to U. Zwicker et al discloses a process in which hydrogenating 0.05 to 1 wt. % of hydrogen in an $\alpha$-type titanium alloy containing at least 6 wt. % of Al to improve the hot workability, and finally, the material is dehydrogenated by heating in a high vacuum. This reference, however, does not mention the microstructure of the material.

(4) In W. R. Kerr et al, "Hydrogen as an Alloying Element in Titanium (Hydrovac)", Titanium '80, pages 2477 through 2486, it is taught that if an $(\alpha+\beta)$-type alloy, Ti-6Al-4V, is hydrogenated, the $\beta$ transformation temperature is lowered and the hot workability is improved, and a fine microstructure is obtained. The hot working, however, is carried out at a reduction not higher than 60% by forging, and this forging is performed by the slow speed ram motion system in which the ram speed of the press is as low as $1.27\times10^{-3}$. Accordingly, this process cannot be applied on an industrial scale.

(5) In N. C. Birla et al, "Anisotropy Control through the Use of Hydrogen in Ti-6Al-4V Alloy", Transactions of the Indian Institute of Metals, Vol. 37, No. 5, October 1984, pages 631 through 635, it is taught that if an $(\alpha+\beta)$-type titanium alloy, Ti-6Al-4V, is hydrogenated and hot-rolled, the anisotropy of the tensile properties is improved. According to the taught process, however, a hydrogenated plate is subjected to homogenization at 990° C. for 2 hours, and is then rolled at 730° C. at a total reduction ratio of 50% in several passes of 10% reduction each with a homogenization treatment of 10 minutes after each reduction, and this process cannot be applied on an industrial scale.

A material having a sufficiently fine and equiaxed microstructure cannot be obtained by these conventional techniques, and titanium and titanium alloy materials having an excellent fatigue strength and workability cannot be stably prepared on an industrial scale by these conventional techniques.

SUMMARY OF THE INVENTION

An object of the present invention is to provide a process in which the microstructures of a titanium material and $\alpha$-type and $(\alpha+\beta)$-type titanium alloy materials can be made finer and equiaxed to levels not attainable by the conventional techniques, and these materials, which have an excellent fatigue strength and workability, can be stably manufactured on an industrial scale.

This object of the present invention can be attained by the following construction.

More specifically, the present invention provides a process for the production of a titanium material and an $(\alpha+\beta)$-type titanium alloy material, which is characterized in that a material hydrogenated 0.02 to 2% by weight of hydrogen included therein is worked at a temperature of 450° to 900° C. at a reduction exceeding 60%, and then the material is dehydrogenated in vacuum and simultaneously annealed. The working of the titanium material is carried out at 450° to 800° C., and the working of the ($\alpha+\beta$)-type titanium alloy material is carried out at 550° to 900° C.

Furthermore, the present invention provides a process for the production of a titanium material and $\alpha$-type and ($\alpha+\beta$)-type titanium alloy materials, which is characterized in that a material hydrogenated 0.02 to 2% by weight of hydrogen included therein is subjected to a heat treatment where the material is heated at a temperature not lower than the $\beta$ transformation temperature and is then cooled, the material is worked at a temperature of 450° to 950° C. at a reduction not lower than 20%, and the material is dehydrogenated in vacuum and simultaneously annealed. The working of the titanium material is carried out at 450° to 800° C., the working of the $\alpha$-type titanium alloy material is carried out at 600° to 950° C, and the working of the ($\alpha+\beta$)-type titanium alloy material is carried out at 550° to 900° C.

DESCRIPTION OF THE PREFERRED EMBODIMENTS

Figure 1:
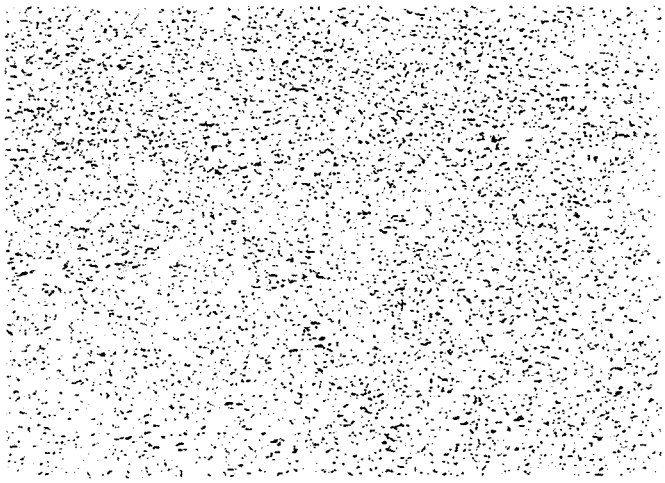
FIGS. 1 and 3 are microphotographs (500 magnifications) of the materials prepared according to the present invention.

With a view to solving the foregoing problems of the conventional techniques, the inventors took note of hydrogen as an element that can be easily added to titanium and a titanium alloy, and can be easily removed therefrom, and carried out various experiments and investigations. As a result, it was found that, if titanium and titanium alloy are hydrogenated, the $\beta$ transformation temperature is lowered by an increase of the solid solution hydrogen and the hot working can be carried out at a temperature lower than the conventionally adopted temperature, and that if after the working at an appropriate reduction, the material is dehydrogenated in vacuum and simultaneously recrystallized and annealed, a material having a fine equiaxial microstructure not attainable by the conventional techniques can be obtained.

The objective material of the present invention includes commercially pure titanium materials such as titanium materials of the JIS standards, $\alpha$-type titanium alloy materials such as Ti-5Al-2.5Sn, and ($\alpha+\beta$)-type titanium alloy materials such as Ti-6Al-4V. Cast materials such as ingots, hot-worked materials prepared through forging, blooming, hot rolling, hot extrusion or the like, cold-rolled materials and materials formed by press molding of powders can be processed according to the present invention.

In the present invention, first, by hydrogenating, 0.02 to 2% by weight of hydrogen is contained in an objective material as mentioned above. If the hydrogen content is lower than 0.02% by weight, even if working, dehydrogenation and annealing are carried out under the conditions described below, an intended fine and equiaxial microstructure cannot be obtained. As the hydrogen content increases, the working can be easily performed at a lower temperature and the effect of making the microstructure finer is enhanced, but if the hydrogen content exceeds 2% by weight, the material per se becomes brittle and handling problems such as breaking during transportation arise. Therefore, the hydrogen content is limited to 0.02 to 2% by weight.

As the means for hydrogenating the material, there can be adopted, for example, an addition of hydrogen to a melt and a heat treatment in a hydrogen-containing atmosphere; the procedures and conditions thereof being not particularly critical. Where hydrogen is not uniformly distributed in the material thereafter, homogenization can be effected by a heat treatment at an appropriate temperature.

The working conditions will now be described. For a titanium material, the working is carried out at a temperature of 450° to 800° C. at a reduction exceeding 60%. For an ($\alpha+\beta$)-type titanium alloy material, the working is carried out at a temperature of 550° to 900° C. at a reduction exceeding 60%. Since a titanium alloy material has a poor hot workability, the titanium alloy material is generally worked at a temperature higher than 900° C. but lower than the $\beta$ transformation temperature by a conventional technique, and therefore, $\alpha$ grains grow and it is difficult to obtain a fine microstructure after working and annealing. In contrast, according to the process of the present invention, since the $\beta$ transformation temperature is lowered by the hydrogenation of the above-mentioned amount of hydrogen, even at the working temperature customarily adopted, a large amount of the $\beta$ phase and a small amount of the $\alpha$ phase exist. Accordingly, the problem caused by the growth of $\alpha$ grains in the conventional technique can be solved. Furthermore, since the $\beta$ phase that can be easily worked is present in a large amount at a lower temperature, the working can be carried out at a lower temperature than in the conventional technique. Moreover, if the working is carried out at the above-mentioned specific temperature and reduction ratio, the microstructure obtained after the recrystallization annealing is sufficiently fine and equiaxial. The upper limit of the working temperature is set as the highest temperature at which the abovementioned effect is attained, and the lower limit is set as the lowest temperature at which work cracking does not occur. The reduction referred to herein means the ->total reduction of the working conducted once or twice or more without reheating.

In the process of the present invention, since the working temperature is relatively low and the reduction is as high as more than 60%, much strain is introduced into the material and a small amount of the $\alpha$ phase exists, and thus the growth of $\alpha$ grains after the working is controlled, and the hydride is precipitated in a dispersed state during the cooling conducted after the working. With this precipitation of the hydride, a high-density dislocation network is introduced into the material, and a high-density dislocation network is also introduced into the hydride per se. Accordingly, if the material is dehydrogenated in vacuum and simultaneously annealed, the hydride disappears, and a microstructure having sufficiently fine equiaxial recrystallization grains is obtained.

Note, since an $\alpha$-type titanium alloy material has an extremely poor hot workability, to produce a material having the above-mentioned microstructure, it is necessary to perform a $\beta$ heat treatment as described below as the preliminary treatment of the hot working.

After the working, the material is dehydrogenated in vacuum and simultaneously annealed. The heating conditions may be those customarily adopted for the recrystallization conducted after the working, but a lower temperature is preferable. If hydrogen remains in an amount exceeding a certain level, even if a fine and equiaxial microstructure is formed by the recrystallization, the material becomes brittle and a satisfactory product can not be obtained. Therefore, the dehydrogenation is conducted in vacuum. It is sufficient if the vacuum degree is a reduced pressure of about $1\times10^{-1}$ Torr or lower. The lower the pressure (the higher the vacuum degree), the shorter the treatment time. From the practical viewpoint, preferably the reduced pressure is about $1\times10^{-4}$ Torr and the remaining gas is an inert gas such as Ar.

The embodiment wherein the heat treatment is carried out as the preliminary treatment of the abovementioned working will now be described. For each of a titanium material, an $\alpha$-type titanium alloy material, and an $(\alpha+\beta)$-type titanium alloy material, by subjecting the hydrogenated material to a heat treatment (hereinafter referred to as "$\beta$ heat treatment") whereby the material is heated at a temperature not lower than the $\beta$ transformation temperature and is then cooled, the microstructure of the material is made finer. When the so-treated material is hot-worked, the reduction at the above-mentioned temperature need not be higher than 60%, but if the reduction is not lower than 20%, the subsequent dehydrogenation and annealing produces a material having a sufficiently fine and equiaxial recrystallization microstructure. Therefore, even in the case of an $\alpha$-type titanium alloy material having an especially poor hot workability, a material having the above-mentioned microstructure can be stably produced on an industrial scale.

According to this $\beta$ heat treatment of the present invention, the material is heated at a temperature not lower than the $\beta$ transformation temperature and is then cooled to obtain a fine structure. Preferably, the heating temperature is as low as possible in the $\beta$ region. Any of furnace cooling, air cooling and water cooling can be adopted, but a higher cooling speed is preferable. If the cooling-terminating temperature is a temperature lower by about 300° C. than the $\beta$ transformation temperature, a fine microstructure can be obtained. After the cooling, the material is directly subjected to the above-mentioned working or the material is once heated or cooled to a predetermined temperature and is then subjected to the above-mentioned working. After the working, the material is dehydrogenated in vacuum and simultaneously annealed, as described hereinbefore.

As apparent from the foregoing description, according to the preparation process of the present invention, titanium and titanium alloy materials having a fine equiaxial microstructure, which cannot be obtained by the conventional techniques, can be stably produced on an industrial scale, and these materials having an excellent strength, fatigue characteristic, and workability can be stably supplied.

EXAMPLES

The present invention will now be described in detail with reference to the following examples, that by no means limit the scope of the invention.

EXAMPLE 1

A slab of a Ti-6Al-4V alloy, hydrogenated in an amount of 0.01, 0.05, 0.2, 0.5, 0.9, 1.5 or 2.2% by weight of hydrogen, was heated at 500°, 600°, 700°, 800° or 950° C. and hot-rolled at a reduction of 40, 60, 70 or 80%. After the hot rolling, the dehydrogenation and annealing were carried out at 700° C for 1 hour in vacuum.

The results of the observation of the microstructures of the hot-rolled, dehydrogenated and annealed materials are shown in Tables 1 through 6. In the hot-rolled and annealed materials obtained at hydrogen contents of 0.05, 0.2, 0.5, 0.9 and 1.5% by weight, heating temperatures of 600°, 700° and 800° C and reduction of 70 and 80%, the microstructure was sufficiently fine and equiaxial.

As a typical instance, the material having a hydrogen content of 0.2% by weight was heated at 750° C., hot-rolled at a reduction of 80% and dehydrogenated and annealed at 700° C. for 1 hour. The microphotograph of the microstructure of the obtained material is shown in FIG. 1. Note, in case of the material having a hydrogen content of 2.2% by weight, the material obtained by cooling to room temperature after the hot-rolling was very brittle, and the subsequent annealing in vacuum could not be performed.

Figure 2:
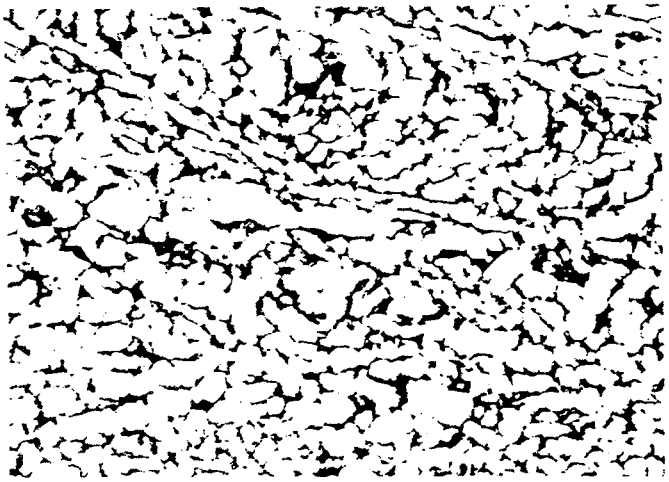
FIGS. 2 and 5 are microphotographs (500 magnifications) of the materials prepared according to the conventional technique.

As an example of the conventional technique, the Ti-6Al-4V alloy which was not hydrogenated was hot-rolled at a heating temperature of 950° C and a reduction of 80%, and was then annealed. The microphotograph of the microstructure of the obtained material is shown in FIG. 2.

It is seen that the material prepared by the process of the present invention has a microstructure which is finer and more equiaxial than the microstructure of the material prepared by the conventional technique.

TABLE 1

Microstructure of Material Having Hydrogen Content of 0.01% by Weight

| | reduction (%) | | | |
|---|---|---|---|---|
| temperature (°C.) | 40 | 60 | 70 | 80 |
| 500 | Δ | Δ | Δ | Δ |
| 600 | Δ | Δ | Δ | Δ |
| 700 | Δ | Δ | Δ | Δ |
| 800 | Δ | Δ | Δ | Δ |
| 950 | x | x | x | x |

o: microstructure of completely fine equiaxial grains
Δ: microstructure of partially fine equiaxial grains
x: coarse or needle microstructure

TABLE 2

Microstructure of Material Having Hydrogen Content of 0.05% by Weight

| | reduction (%) | | | |
|---|---|---|---|---|
| temperature (°C.) | 40 | 60 | 70 | 80 |
| 500 | Δ | Δ | Δ | Δ |
| 600 | Δ | Δ | o | o |
| 700 | Δ | Δ | o | o |
| 800 | Δ | Δ | o | o |
| 950 | x | x | x | x |

TABLE 3

Microstructure of Material Having Hydrogen Content of 0.2% by Weight

| | reduction (%) | | | |
|---|---|---|---|---|
| temperature (°C.) | 40 | 60 | 70 | 80 |
| 500 | Δ | Δ | Δ | Δ |
| 600 | Δ | Δ | o | o |

TABLE 3-continued

| Microstructure of Material Having Hydrogen Content of 0.2% by Weight | | | | |
|---|---|---|---|---|
| | reduction (%) | | | |
| temperature (°C.) | 40 | 60 | 70 | 80 |
| 700 | Δ | Δ | ○ | ○ |
| 800 | Δ | Δ | ○ | ○ |
| 950 | x | x | x | x |

TABLE 4

| Microstructure of Material Having Hydrogen Content of 0.5% by Weight | | | | |
|---|---|---|---|---|
| | reduction (%) | | | |
| temperature (°C.) | 40 | 60 | 70 | 80 |
| 500 | Δ | Δ | Δ | Δ |
| 600 | Δ | Δ | ○ | ○ |
| 700 | Δ | Δ | ○ | ○ |
| 800 | Δ | Δ | ○ | ○ |
| 950 | x | x | x | x |

TABLE 5

| Microstructure of Material Having Hydrogen Content of 0.9% by Weight | | | | |
|---|---|---|---|---|
| | reduction (%) | | | |
| temperature (°C.) | 40 | 60 | 70 | 80 |
| 500 | Δ | Δ | Δ | Δ |
| 600 | Δ | Δ | ○ | ○ |
| 700 | Δ | Δ | ○ | ○ |
| 800 | Δ | Δ | ○ | ○ |
| 950 | x | x | x | x |

TABLE 6

| Microstructure of Material Having Hydrogen Content of 1.5% by Weight | | | | |
|---|---|---|---|---|
| | reduction (%) | | | |
| temperature (°C.) | 40 | 60 | 70 | 80 |
| 500 | Δ | Δ | Δ | Δ |
| 600 | Δ | Δ | ○ | ○ |
| 700 | Δ | Δ | ○ | ○ |
| 800 | Δ | Δ | ○ | ○ |
| 950 | x | x | x | x |

EXAMPLE 2

A slab of a Ti-6Al-4V alloy hydrogenated in an amount of 0.2% by weight of hydrogen was heated at 850° or 950° C., that is, a temperature higher than the $\beta$ transformation temperature at this hydrogen content, air-cooled, re-heated at 500°, 600°, 700°, 750°, 800° or 950° C. and worked at a reduction ratio of 22, 40, 60 or 80%. Then, the material was dehydrogenated and annealed at 700° C. in vacuum for 1 hour. The results of the observation of the microstructures of the obtained materials are shown in Tables 7 and 8. If the heating temperature for the hot working was 600°, 700°, 750° or 800° C., the annealed materials had a fine equiaxial microstructure at any reduction.

TABLE 7

| Microstructure of Material Having Hydrogen Content of 0.2% by Weight, Heated at 850° C. and Cooled | | | | |
|---|---|---|---|---|
| | reduction (%) | | | |
| temperature (°C.) | 22 | 40 | 60 | 80 |
| 500 | Δ | Δ | Δ | Δ |
| 600 | ○ | ○ | ○ | ○ |
| 700 | ○ | ○ | ○ | ○ |
| 750 | ○ | ○ | ○ | ○ |
| 800 | ○ | ○ | ○ | ○ |
| 950 | x | x | x | x |

TABLE 8

| Microstructure of Material Having Hydrogen Content of 0.2% by Weight, Heated at 950° C. and Cooled | | | | |
|---|---|---|---|---|
| | reduction (%) | | | |
| temperature (°C.) | 22 | 40 | 60 | 80 |
| 500 | Δ | Δ | Δ | Δ |
| 600 | ○ | ○ | ○ | ○ |
| 700 | ○ | ○ | ○ | ○ |
| 750 | ○ | ○ | ○ | ○ |
| 800 | ○ | ○ | ○ | ○ |
| 950 | x | x | x | x |

○: microstructure of completely fine equiaxial grains
Δ: microstructure of partially fine equiaxial grains
x: coarse or needle microstructure

EXAMPLE 3

Ti-5Al-2.5Sn, a typical $\alpha$-type titanium alloy, was used as the sample, and slabs having a thickness of 100 mm, which differed in the hydrogen content, were heated at a temperature not lower than the $\beta$ transformation temperature corresponding to the hydrogen content and cooled to room temperature to effect the $\beta$ heat treatment. The materials were hot-rolled at various heating temperatures and reductions ratios, and then the materials were heated at 700° C under a vacuum of $1 \times 10^4$ Torr for 5 hours to dehydrogenate same and effect a recrystallization.

The results of the microstructures of the finally obtained materials, as well as the preparation conditions, are shown in Table 9. At the evaluation of the structure, mark "○" indicates a completely fine and equiaxial microstructure, mark "Δ" indicates a partially fine and equiaxial microstructure, and mark "x" indicates a coarse or drawn grain microstructure. Note, at run No. 14, cracking occurred because the hot rolling temperature was low, and rolling was impossible. At run No. 16, since the hydrogen content was high, the material was brittle in the cooled state after the hot rolling and subsequent treatment was impossible.

Figure 3:
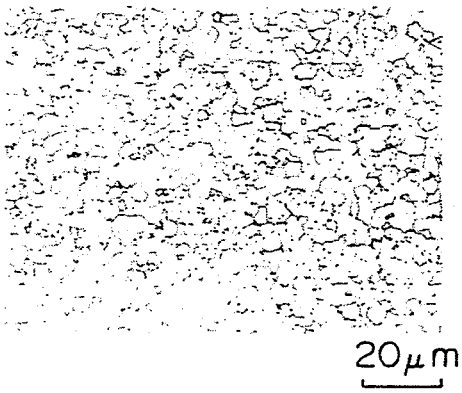
Figure 4:
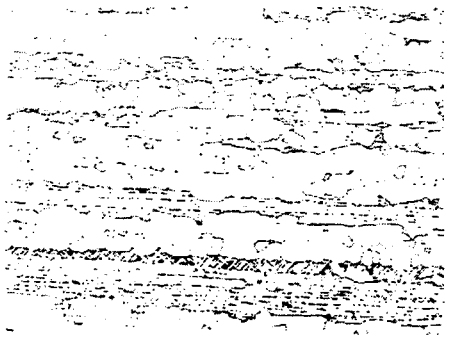
FIG. 4 is a microphotograph (500 magnifications) of a comparative material.
Figure 5:
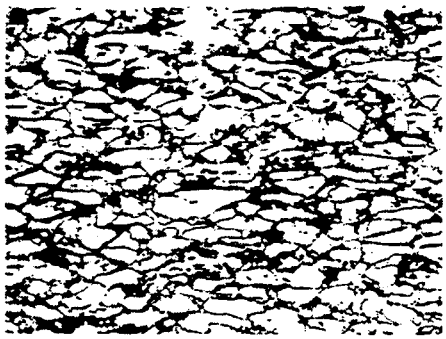

As typical instances, the microphotographs of the microstructures of the material of run No. 8 according to the present invention, the comparative material of run No. 13 and the conventional material obtained by rolling the not hydrogenated material at 980° C. at a reduction of 50% repeatedly and heating the material at 700° C. for 5 hours are shown in FIGS. 3, 4 and 5, respectively.

It is seen that, according to the process of the present invention, an $\alpha$-type alloy having a fine equiaxial microstructure can be obtained.

TABLE 9

| Run No. | Hydrogen Content (% by weight) | β Heat Treatment Temperature (°C.) | Hot Rolling Temperature (°C.) | Reduction (%) | Evaluation of Microstructure | Classification |
|---|---|---|---|---|---|---|
| | | Ti-5 Al-2.5 Sn (β Heat Treatment Effected) | | | | |
| 1 | 0.02 | 1050 | 950 | 90 | ∘ | Present invention |
| 2 | 0.3 | 950 | 900 | 80 | ∘ | Present invention |
| 3 | " | 950 | 800 | 60 | ∘ | Present invention |
| 4 | " | 950 | 750 | 40 | ∘ | Present invention |
| 5 | 0.5 | 900 | 900 | 60 | ∘ | Present invention |
| 6 | " | 900 | 800 | 20 | ∘ | Present invention |
| 7 | " | 900 | 800 | 40 | ∘ | Present invention |
| 8 | " | 900 | 800 | 70 | ∘ | Present invention |
| 9 | " | 900 | 650 | 50 | ∘ | Present invention |
| 10 | 1.0 | 850 | 750 | 70 | ∘ | Present invention |
| 11 | " | 850 | 600 | 30 | ∘ | Present invention |
| 12 | 2.0 | 850 | 600 | 20 | ∘ | Present invention |
| 13 | 0.01 | 1050 | 950 | 90 | x | Comparison |
| 14 | 0.5 | 900 | 550 | — | — | " |
| 15 | " | 900 | 1000 | 95 | Δ | " |
| 16 | 2.2 | 850 | 600 | 20 | — | " |

EXAMPLE 4

Commercially pure titanium materials of JIS grade 2 were subjected to the operations of up to the hot rolling in the same manner as described in Example 3, and materials in which the β heat treatment was not effected were heated at 600° C. in vacuum of $1\times10^{-4}$ Torr for 1 hour until dehydrogenated and annealed. The results are shown in Table 10 (the β heat treatment was not effected) and Table 11 (the β heat treatment was effected). At run No. 14 in Table 10 and run No. 15 in Table 11, since the hot rolling temperature was low, cracking occurred and rolling was impossible. At run No. 17 in Table 10 and run No. 17 in Table 11, the material was very brittle in the cooled state after the hot rolling because the hydrogen content was high, and subsequent treatment was impossible.

It is seen that according to the process of the present invention, a titanium material having a fine equiaxial microstructure can be obtained.

In the foregoing examples, slabs were rolled and the formed sheet materials were examined. It was confirmed that similar results were obtained in the case of rods, wires and shaped materials formed by rolling billets, materials of various shapes formed by hot-extruding billets, forged materials, and powder shaped materials.

TABLE 10

| Run No. | Hydrogen Content (% by weight) | Hot Rolling Temperature (°C.) | Reduction (%) | Evaluation of Microstructure | Classification |
|---|---|---|---|---|---|
| | | Titanium of JIS grade 2 (β Heat Treatment Not Effected) | | | |
| 1 | 0.02 | 800 | 90 | ∘ | Present invention |
| 2 | 0.3 | 750 | 80 | ∘ | Present invention |
| 3 | " | 680 | 70 | ∘ | Present invention |
| 4 | " | 600 | 65 | ∘ | Present invention |
| 5 | 0.5 | 750 | 65 | ∘ | Present invention |
| 6 | " | 680 | 65 | ∘ | Present invention |
| 7 | " | 600 | 65 | ∘ | Present invention |
| 8 | " | 600 | 95 | ∘ | Present invention |
| 9 | " | 500 | 70 | ∘ | Present invention |
| 10 | 1.0 | 700 | 80 | ∘ | Present invention |
| 11 | " | 450 | 65 | ∘ | Present invention |
| 12 | 2.0 | 450 | 65 | ∘ | Present invention |
| 13 | 0.01 | 800 | 90 | x | Comparison |
| 14 | 0.5 | 400 | — | — | " |
| 15 | " | 850 | 90 | x | " |
| 16 | " | 600 | 60 | Δ | " |
| 17 | 2.2 | 450 | 65 | — | " |

TABLE 11

| Run No. | Hydrogen Content (% by weight) | β Heat Treatment Temperature (°C.) | Hot Rolling Temperature (°C.) | Reduction (%) | Evaluation of Microstructure | Classification |
|---|---|---|---|---|---|---|
| | | Titanium of JIS grade 2 (β Heat Treatment Effected) | | | | |
| 1 | 0.02 | 900 | 800 | 90 | ∘ | Present invention |
| 2 | 0.3 | 800 | 750 | 80 | ∘ | Present invention |
| 3 | " | 800 | 680 | 60 | ∘ | Present invention |
| 4 | " | 800 | 600 | 40 | ∘ | Present invention |
| 5 | 0.5 | 750 | 750 | 60 | ∘ | Present invention |
| 6 | " | 750 | 680 | 40 | ∘ | Present invention |
| 7 | " | 750 | 600 | 20 | ∘ | Present invention |
| 8 | " | 750 | 600 | 40 | ∘ | Present invention |
| 9 | " | 750 | 600 | 70 | ∘ | Present invention |
| 10 | " | 750 | 500 | 50 | ∘ | Present invention |
| 11 | 1.0 | 700 | 700 | 70 | ∘ | Present invention |
| 12 | " | 700 | 450 | 30 | ∘ | Present invention |
| 13 | 2.0 | 650 | 450 | 20 | ∘ | Present invention |
| 14 | 0.01 | 900 | 800 | 90 | x | Comparison |
| 15 | 0.5 | 750 | 400 | — | — | " |

TABLE 11-continued

| | | Titanium of JIS grade 2 (β Heat Treatment Effected) | | | | |
|---|---|---|---|---|---|---|
| Run No. | Hydrogen Content (% by weight) | β Heat Treatment Temperature (°C.) | Hot Rolling Temperature (°C.) | Reduction (%) | Evaluation of Microstructure | Classification |
| 16 | " | 750 | 850 | 95 | Δ | " |
| 17 | 2.2 | 650 | 450 | 20 | — | " |

We claim:

1. A process for the production of titanium and titanium alloy materials having a fine equiaxial microstructure, which comprises processing a titanium or $(\alpha+\beta)$-type titanium alloy material hydrogenated in an amount of 0.02 to 2% by weight of hydrogen, working at a temperature of 450° to 900° C. at a reduction exceeding 60%, dehydrogenating the material in vacuum, and simultaneously recrystallization annealing the material.

2. A process according to claim 1, wherein the titanium material is worked at a temperature of 450° to 800° C.

3. A process according to claim 1, wherein the $(\alpha+\beta)$-type titanium alloy material is worked at a temperature of 550° to 900° C.

4. A process for the production of titanium and titanium alloy materials having a fine equiaxial microstructure, which comprises processing a titanium α-type titanium alloy or $(\alpha+\beta)$-type titanium alloy material hydrogenated in an amount of 0.02 to 2% by weight of hydrogen by subjecting the material to a heat treatment whereby the material is heated at a temperature not lower than the β transformation temperature and is then cooled to a cooling-terminating temperature which is lower by about 300° C. or more than the β -transformation temperature, working the material at a temperature of 450° to 950° C. at a reduction not lower than 20%, dehydrogenating the material in a vacuum, and simultaneously recrystallization annealing the material.

5. A process according to claim 4, wherein the titanium material is worked at a temperature of 450° to 800° C.

6. A process according to claim 4, wherein the α-type titanium alloy material is worked at a temperature of 600° to 950° C.

7. A process according to claim 4, wherein the $(\alpha+\beta)$-type titanium alloy material is worked at 550° to 900° C.

* * * * *

UNITED STATES PATENT AND TRADEMARK OFFICE

CERTIFICATE OF CORRECTION

PATENT NO. : 5,092,940

DATED : March 3, 1992

INVENTOR(S) : Kinichi KIMURA, et al.

It is certified that error appears in the above-identified patent and that said Letters Patent is hereby corrected as shown below:

ABSTRACT, line 6, between "in" and "vacuum." insert --a--.

ABSTRACT, line 15, change "cooled, the" to --cooled. The--.

ABSTRACT, line 17, between "20%," and "the" insert --after which--.

ABSTRACT, line 18, change "vacuum, the" to --vacuum. The--.

Column 1, second line of heading, change "material" to --materials--.

Column 1, line 29, change "an strong" to --a strong--.

Column 1, line 33, between "have" and "sufficiently" delete "a".

Column 2, line 45, after "reduction" insert a comma.

Column 3, line 16, change "cooled, the" to --cooled. The--.

UNITED STATES PATENT AND TRADEMARK OFFICE

CERTIFICATE OF CORRECTION

PATENT NO. : 5,092,940

DATED : March 3, 1992

INVENTOR(S) : Kinichi KIMURA, et al.

It is certified that error appears in the above-identified patent and that said Letters Patent is hereby corrected as shown below:

Column 3, line 27, bold "3".

Column 3, line 30, bold "5".

Column 3, line 68, before "dehydrogenation" insert --and if--.

Column 4, line 50, delete the symbol before "total reduction".

Column 8, line 40, change "reductions ratios," to --reduction ratios,--.

Col. 8, line 48, change "0" to --o--.

Column 8, line 62, change "not" to --hot--.

UNITED STATES PATENT AND TRADEMARK OFFICE

CERTIFICATE OF CORRECTION

PATENT NO. : 5,092,940

DATED : March 3, 1992

INVENTOR(S) : Kinichi KIMURA, et al.

It is certified that error appears in the above-identified patent and that said Letters Patent is hereby corrected as shown below:

Col. 9, line 45, change "powder shaped" to

--powder-shaped--.

Signed and Sealed this

Twenty-fourth Day of August, 1993

*Attest:*

*Attesting Officer*

BRUCE LEHMAN

*Commissioner of Patents and Trademarks*